US007413279B2

(12) United States Patent
Arakawa et al.

(10) Patent No.: US 7,413,279 B2
(45) Date of Patent: Aug. 19, 2008

(54) INKJET PRINTER

(75) Inventors: Hiroaki Arakawa, Uenohara-machi (JP); Takayuki Kato, Hachioji (JP); Shingo Tsubotani, Kunitachi (JP)

(73) Assignee: Konica Minolta Holdings, Inc., Tokyo (JP)

( * ) Notice: Subject to any disclaimer, the term of this patent is extended or adjusted under 35 U.S.C. 154(b) by 337 days.

(21) Appl. No.: 11/250,719

(22) Filed: Oct. 14, 2005

(65) Prior Publication Data

US 2006/0082605 A1 Apr. 20, 2006

(30) Foreign Application Priority Data

Oct. 18, 2004 (JP) ..... 2004-303464
Aug. 29, 2005 (JP) ..... 2005-248434

(51) Int. Cl.
*B41J 29/393* (2006.01)
*B41J 29/38* (2006.01)

(52) U.S. Cl. ..... 347/19; 347/14

(58) Field of Classification Search ..... 347/14, 347/19

See application file for complete search history.

(56) References Cited

U.S. PATENT DOCUMENTS

2003/0132981 A1 * 7/2003 Arakawa et al. ..... 347/19

FOREIGN PATENT DOCUMENTS

| | | |
|---|---|---|
| JP | 09-174835 | 7/1997 |
| JP | 11-300964 | 2/1999 |
| JP | 11-300944 | 11/1999 |
| JP | 2003-039667 | 2/2003 |
| JP | 2003-094629 | 4/2003 |
| JP | 2003-136696 | 5/2003 |
| JP | 2003-191467 | 7/2003 |

* cited by examiner

*Primary Examiner*—Julian D Huffman
(74) *Attorney, Agent, or Firm*—Lucas & Mercanti, LLP

(57) ABSTRACT

An inkjet printer, including a recording head having a nozzle to jet ink droplets, a control section to control jetting of the ink droplets from the nozzle of the recording head at predetermined driving conditions for jetting the ink droplets, a velocity detecting section to detect ink droplets jetting velocity from the nozzle of the recording head, a temperature detecting section to detect temperature of the recording head or ambient temperature of the recording head, a first changing section to change the driving conditions to alter the ink droplets jetting velocity to a targeted velocity based on detected results of the velocity detecting section, and a second changing section to change the driving conditions at a time differing from a time of the first changing section to alter the ink droplets jetting velocity to the targeted velocity based on the detected results of the temperature detecting section.

13 Claims, 6 Drawing Sheets

FIG. 5 ( a )
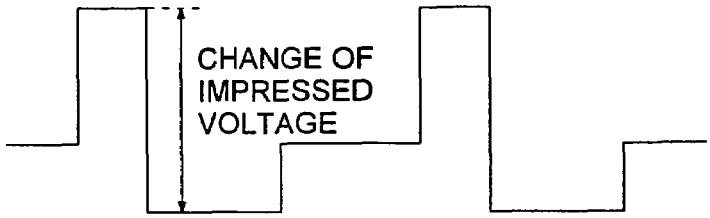
FIG. 5 ( b )
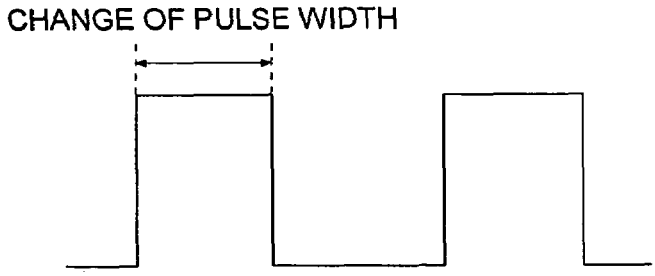
FIG. 5 ( c )
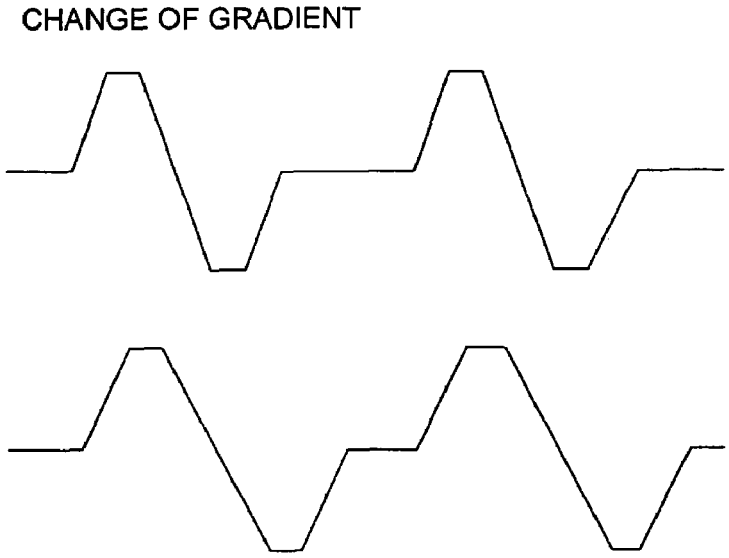

INKJET PRINTER

This application is based on Japanese Patent Application Nos. 2004-303464 filed on Oct. 18, 2004 and 2005-248434 filed on Aug. 29, 2005 in the Japanese Patent Office.

BACKGROUND OF THE INVENTION

The present invention relates to an inkjet printer, and in particular, to an inkjet printer wherein effectively restricted is deterioration of quality of printed images, due to viscosity reduction of ink by temperature change and also due to structural differences of variation of structural parts.

Inkjet printers perform image printing in the following manner: the inkjet printer jets small ink droplets, from a plurality of nozzles which are integrally formed in a recording head, onto a recording media such as a paper sheet, to land the ink droplets on the paper sheet, and further the inkjet printer produces printed images on a predetermined recording surface of the recording media, via driving the recording head in the main scanning direction across the width direction of the sheet. In such an inkjet printer, if there is any displacement of the deposited ink droplet jetted from the nozzles of the recording head driven in the main scanning direction, the recorded images includes turbulences, resulting in deterioration of image quality. Accordingly, the jetting velocity must be precisely controlled.

Generally, ink viscosity changes due to temperature, whereby ink viscosity changes due to temperature of the recording head as well as the ambient temperature. Since the jetting velocity of the ink droplet varies by the change of the ink viscosity, the number of jetted droplets also varies, which results in the change of image density, and further, the change of the landing position generates unclear images, which are unacceptable images.

Yet further, temperature characteristics of the various mechanical or electronic parts structuring the inkjet printer vary, and in addition, since each inkjet printer has its own structural difference, changes in image density due to these structural differences result in image deterioration.

In the past, in order to overcome the above-mentioned image deterioration, proposed was technology wherein the ink droplets jetting velocity was measured, and driving conditions of the recording head were controlled by the measured velocity (Patent Documents 1, 2 and 3). Further proposed is technology wherein the ink droplets jetting velocity and weight of ink droplet are measured, and driving condition of the recording head is controlled by the measured droplet velocity and weight (Patent Document 4). Yet further proposed is technology wherein the ink droplets jetting velocity and weight are measured, and the driving condition of the recording head is controlled by the measured velocity and weight (Patent Document 5), while yet further proposed is technology wherein the ink droplets jetting velocity is measured, and a heater to heat the ink is controlled, whereby the ink viscosity is controlled (Patent Document 6).

[Patent Document 1] JP-A 9-174835
[Patent Document 2] JP-A 11-300944
[Patent Document 3] JP-A 2003-39667
[Patent Document 4] JP-A 11-300964
[Patent Document 5] JP-A 2003-94629
[Patent Document 6] JP-A 2003-136696
[Patent Document 7] JP-A 2003-191467

As Patent Documents 1-7 show, when the driving condition of the recording head is controlled by the ink droplets jetting velocity, to correctly secure the ink droplets jetting velocity which tend to change, the ink droplets jetting velocity must be measured frequently. However when it is measured during printing, continuity of the density at that time point may be altered. Still further, in order to correctly measure the ink droplets jetting velocity, measurement must be conducted while the ink jetting condition of the recording head is maintained in good condition, in which it takes a long time to measure the ink droplet jetting velocity. Accordingly the driving condition of the recording head cannot be frequently controlled by the ink droplets jetting velocity.

On the other hand, without measuring the ink droplets jetting velocity, but depending on temperature characteristics of ink viscosity, by measuring ambient temperature or recording head temperature, the driving condition can be controlled by those measured results. Since this case differs from the case of controlling by the ink jetting velocity, there is no need to measure the velocity while the ink is practically jetted, and which can be conducted while image printing, and further the time interval between temperature measurement and the control of driving condition of the recording head can be shortened, which is an advantage for securing continuity of density. However, this method includes difference of temperature characteristics of a thermal detector, ink viscosity and a circuit board, and in addition, there is variation due to structural differences or ink changes, which cause changes of density, therefore, correct control is difficult in practice.

In addition, Patent Document 7 teaches that the ink droplets jetting velocity is controlled by a relationship table between the ambient temperature and the ink droplets jetting velocity, however, the driving condition is corrected only when the ink droplets jetting velocity is detected, which does not solve the above described problems.

Accordingly, in the present invention, the problem is to provide an inkjet printer, wherein solved are various problems in the ink jetting velocity control by measuring velocity or temperature, wherein printing is continuously and stably conducted, independent of structural difference and ambient differences, and wherein excellent image quality continuously results.

SUMMARY OF THE INVENTION

The problems of the present invention will be cleared up by the following descriptions.

The problems will be overcome by the structures described below.

Structure 1

An ink jet printer, including:

a recording head having a nozzle to jet ink droplets, a control means to control jetting of the ink droplets from the nozzle of the recording head at predetermined driving conditions;

a velocity detecting means to detect velocity of ink droplets jetted from the nozzle of the recording head;

a temperature detecting means to detect temperature of the recording head or ambient temperature of the recording head;

a first changing means to change the driving condition to alter the ink droplets jetting velocity to the targeted velocity based on detected results of the velocity detecting means; and a second changing means to change the driving condition on a time different from the first changing means to alter the ink droplets jetting velocity to the targeted velocity based on detected results of the temperature detecting means.

Structure 2

The inkjet printer described in Structure 1, wherein the second changing means changes the last driving condition changed by the first changing means or the second changing means, based on any differences from the detected results of the temperature detecting means just at the time or near when the last driving conditions were changed.

Structure 3

The inkjet printer described in Structure 1, wherein the second changing means changes the driving conditions altered by the first changing means, based on any difference from the detected results of the temperature detecting means just at the time or near when the driving conditions were changed.

Structure 4

The inkjet printer described in Structure 1, 2 or 3, wherein the time when the second changing means changes the driving condition is more frequently than the time when the first changing means changes the driving condition.

Structure 5

The inkjet printer described in any one of Structures 1 to 4, wherein the velocity detection conducted by the velocity detecting means and the change of the driving condition, to be conducted by the first changing means based on the result of the velocity detection, are conducted just when electrical power is supplied to the inkjet printer and/or just before printing is conducted, and wherein the temperature detection conducted by the temperature detecting means and any change of the driving conditions, conducted by the second changing means based on the results of the temperature detection of the temperature detecting means, are conducted at the predetermined times and more frequently than the velocity detection conducted by the velocity detecting means and the change of the driving condition, to be conducted by the first changing means based on the result of the velocity detection.

Structure 6

The inkjet printer described in any one of Structures 1 to 5, further including a memory means which stores at least the driving condition ultimately changed by the first changing means before the inkjet printer is deactivated, and the detected result of the temperature detecting means which was detected just at the time or near when the driving conditions were changed, wherein just when the electrical power is supplied, the second changing means changes the driving condition stored in the memory means, based on any difference between the detected result of the temperature detecting means, just when the electrical power is supplied and the detected result of the temperature detecting means stored in the memory means.

Structure 7

An inkjet printer, including:

a recording head having a nozzle to jet ink droplets;

a jet control means to control jetting of the ink droplets from the nozzle of the recording head under predetermined driving conditions;

a velocity detecting means to detect the jetting velocity of the ink droplets jetted from the nozzle of the recording head;

a temperature detecting means to detect temperature of the recording head and ambient temperature of the recording head;

a first changing means to change the driving condition based on the detected result of the velocity detecting means so as to change the jetting velocity of the ink droplets to become targeted velocity; and a second changing means to change the driving condition based on the detected results of the temperature detecting means so as to change the jetting velocity of the ink droplets to become the targeted velocity;

wherein the second changing means changes the last driving condition changed by the first changing means or the second changing means, based on any differences of temperature from the detected results of the temperature detecting means just at the time or near when the last driving conditions were changed, wherein velocity detection by the velocity detecting means and any change of the driving conditions by the first changing means are conducted just when the electrical power is supplied and/or just before printing is conducted, and wherein detection of temperature by the temperature detecting means and any change of the driving conditions by the second changing means are conducted while printing.

Structure 8

An inkjet printer, including:

a recording head having a nozzle to jet ink droplets;

a jet control means to control jetting of the ink droplets from the nozzle of the recording head under predetermined driving conditions;

a velocity detecting means to detect the jetting velocity of the ink droplets jetted from the nozzle of the recording head;

a temperature detecting means to detect temperature of the recording head and ambient temperature near the recording head;

a first changing means to change the driving conditions based on the detected results of the velocity detecting means so as to change the jetting velocity of the ink droplets to the targeted velocity; and a second changing means to change the driving conditions at a time differing from the first changing means, so as to change the jetting velocity of the ink droplets to the targeted velocity, based on the detected result of the temperature detecting means, wherein the second changing means changes the driving conditions which were last changed by the first changing means, based on any difference of temperature from the detected result of the temperature detecting means just at or near the change of the driving conditions, wherein both the velocity detection by the velocity detecting means and any change of driving conditions by the first changing means are conducted just when the electrical power is supplied to the inkjet printer and/or just before printing is started, while the temperature detection by the temperature detecting means and any changes of driving conditions by the second changing means are conducted while printing.

Structure 9

The inkjet printer described in any one of Structures 1-8, wherein any changes of driving condition correspond to any one of change of driving signal voltage, change of pulse width of the driving signal, and change of gradient of rising edge of the driving signal.

Structure 10

The inkjet printer described in any one of Structures 1-9, further including a cleaning means to normalize condition of the recording head via cleaning the recording head, and a controlling means to operate the cleaning means just before the velocity detecting means detects the jetting velocity of the ink droplets.

Structure 11

The inkjet printer described in Structure 10, wherein the cleaning means includes a wiping means to wipe the nozzle surfaces of the recording head, and/or an ink aspiration means to aspirate ink from the nozzle of the recording head.

BRIEF DESCRIPTION OF THE DRAWINGS

FIG. 5(*a*) shows an example for changing the voltage of the driving signal to be impressed to the recording head.

FIG. 5(*b*) shows an example for changing a pulse width of the driving signal to be impressed to the recording head.

FIG. 5(*c*) shows is a wave form chart showing an example for changing the gradient of the rising edge of the driving signal to be impressed to the recording head.

DETAILED DESCRIPTION OF THE PREFERRED EMBODIMENTS

Figure 1:
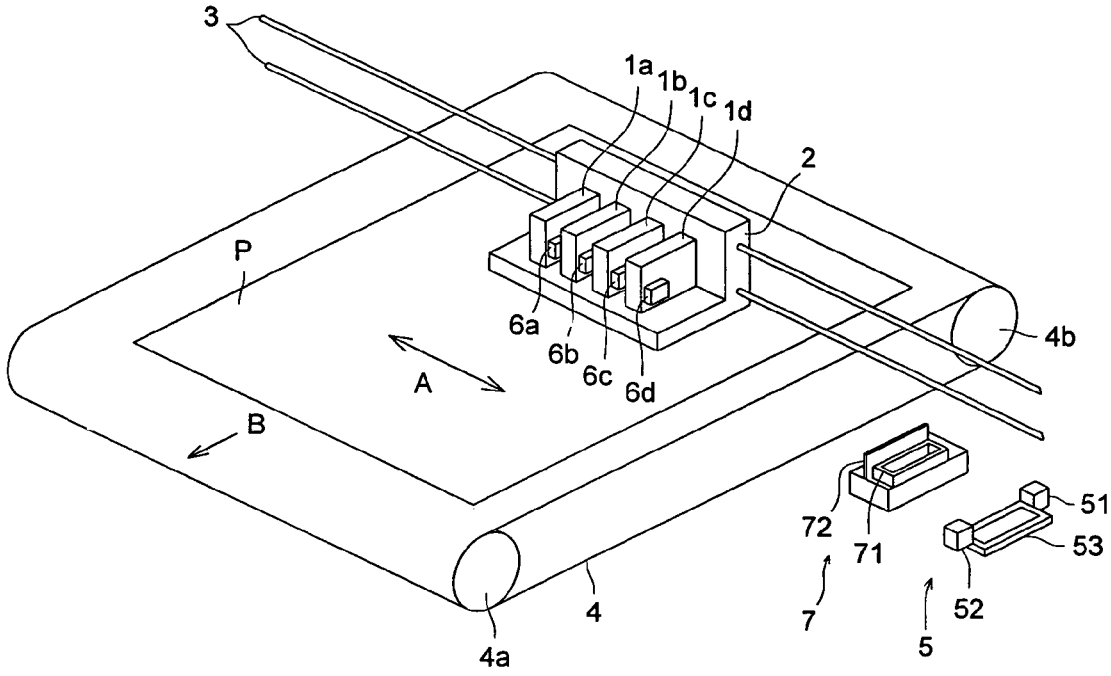
FIG. 1 is a perspective view of the main sections of the inkjet printer.

Embodiments of the present invention will be described below referring to the drawings.

Figure 2:
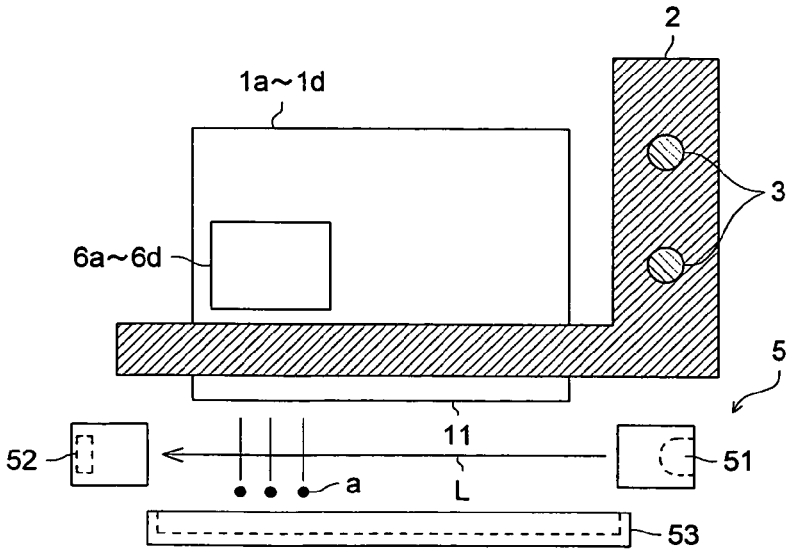
FIG. 2 is a drawing to explain the velocity detection of the ink droplets via a velocity detecting device.
Figure 3:
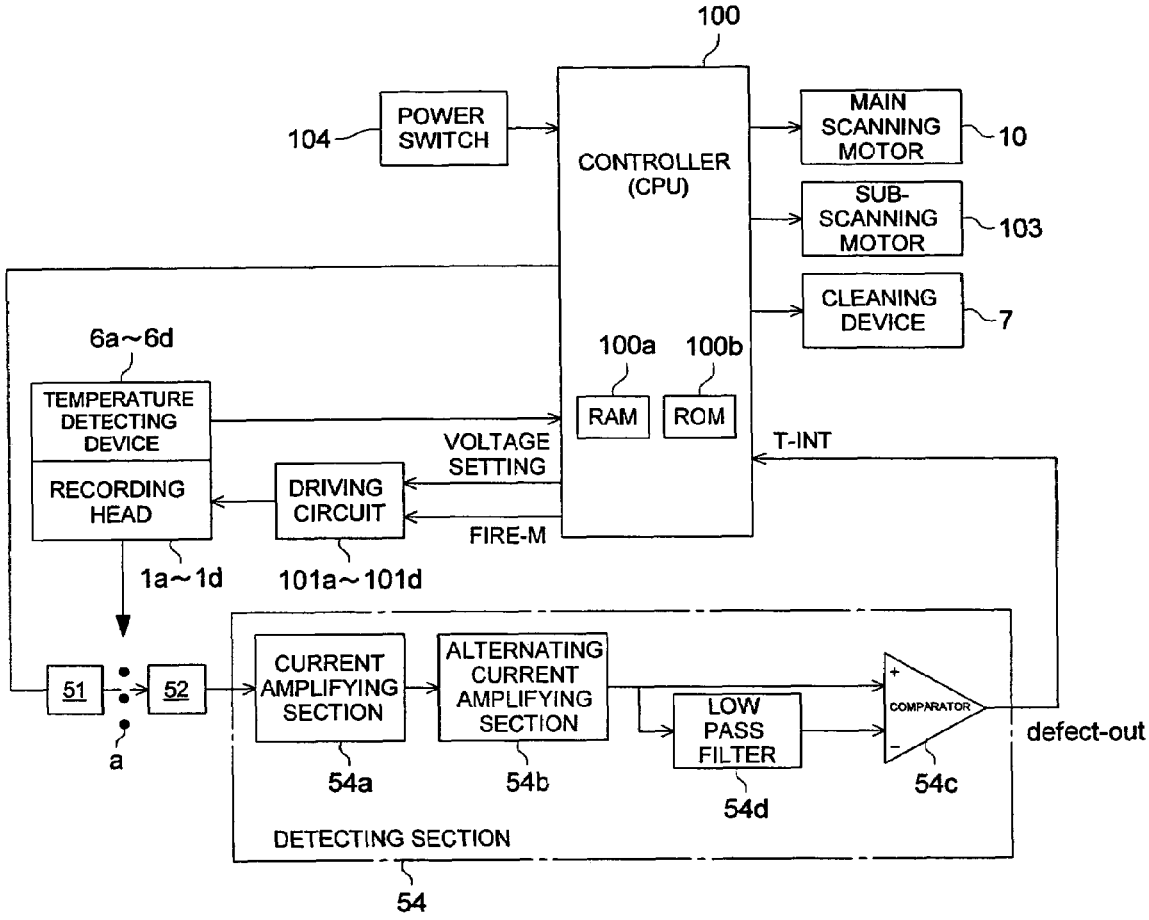
FIG. 3 is a block diagram of the interior structure of the main sections of the inkjet printer.

FIG. 1 is a perspective view showing critical areas of the inkjet printer, FIG. 2 is a drawing to explain the velocity detection via a velocity detecting device, while FIG. 3 is a block diagram showing an interior structure of the main part of the inkjet printer.

In FIG. 1, numerals 1*a*-1*d* represent four recording heads mounted on carriage 2 to jet various colored ink which are, for example, yellow, magenta, cyan and black. Carriage 2 is mounted on two guide rails 3 which are parallel to each other and arranged in a main scanning direction "A", which reciprocates on guide rails 3 by main scanning motor 102 not illustrated in FIG. 1 (see FIG. 3).

Looped conveyance belt 4 is provided under-carriage 2, and is entrained about conveyance rollers 4*a* and 4*b* assembled in a predetermined distance in the sub-scanning direction shown by "B" in FIG. 1. Sub-scanning motor 103, which is not illustrated in FIG. 1, but illustrated in FIG. 3, is connected to conveyance roller 4*b* to transfer driving force. By the rotation of sub-scanning motor 103, looped conveyance belt 4 rotates, and thereby recording media, such as a paper sheet, a plastic film or cloth, loaded on looped conveyance belt 4 is conveyed in sub-scanning direction "B".

In FIG. 1, numeral 5 represents a velocity detecting device, incorporating light emitting element 51, such as an LED or laser, light receiving element 52, such as a photo diode, ink tray 53 to catch ink droplets "a" to be jetted for the velocity detection, and detecting section 54 (see FIG. 3) to detect a light receiving signal. At least light emitting element 51, light receiving element 52, and ink tray 53 are arranged at a non-recording position, where carriage 2 is away on recording media P.

In FIG. 2, light emitting element 51 of velocity detecting device 5 emits detecting light L to detect the passage of ink droplets "a" jetted from each nozzle of recording head 1. Light receiving element 52 receives detecting light L emitted from light emitting element 51. Detecting light L is emitted orthogonally to main scanning direction "A" of recording heads 1*a*-1*d*, and parallel to the alignment of the nozzles of recoding heads 1*a*-1*d*. The height of detecting light L in the jetting direction of ink droplets "a" is lower than nozzle surface 11 of recording heads 1*a*-1*d*. Accordingly, when the nozzle array of any one of recording heads 1*a*-1*d* is positioned on detecting light L, the path of ink droplets "a" jetted from said nozzle array crosses detecting light beam L.

In addition, in this case, to detect the velocity of ink droplets for each of recording heads 1*a*-1*d*, velocity detecting device 5 includes one set of light emitting element 51 and light receiving element 52 for each of the four recording heads 1*a*-1*d*, however, the number of sets of light emitting element 51 and light receiving element 52 can be the same as the number of recording heads.

Further, in FIG. 1, each of recording heads 1*a*-1*d* incorporates temperature detecting devices 6*a*-6*d* to detect the temperature of each of recording heads 1*a*-1*d*. The results detected via temperature detecting devices 6*a*-6*d* are sent to controller 100 (see FIG. 3).

Numeral 7 represents a cleaning device which cleans recording heads 1*a*-1*d* for the purpose of normalizing the jetting conditions of ink droplets "a" from each of recording heads 1*a*-1*d*, and is also driven by commands from controller 100 (see FIG. 3). Cleaning device 7 closely contacts the nozzle surfaces of recording heads 1*a*-1*d*, and incorporates aspiration cap 71 which aspirates ink from the nozzles and removes any clogged ink from the nozzles of the recording heads, as well as wiping member 72, being an elastic plate such as rubber, which removes any remaining ink from the nozzle surface. In addition, either aspiration cap 71 or wiping member 72 can be operated as cleaning device 7.

In the embodiment of the inkjet printer of this invention, controller (CPU) 100 activates main scanning motor 102 to drive carriage 2 in main scanning direction "A". While carriage 2 is driven, controller 100 operates driving circuits 101*a*-101*d*, provided for each of recording heads 1*a*-1*d*, at predetermined time under predetermined conditions, and thereby ink droplets "a" are jetted from recording heads 1*a*-1*d* onto recording media P temporarily stopped on conveyance belt 4. Controller 100 incorporates the memory devices such as RAM 100*a* and ROM 100*b*, and said predetermined conditions have been rewritably stored in a predetermined area of RAM 100*a*, being a nonvolatile memory section.

As the driving conditions for jetting the ink droplets from the nozzles of recording heads 1*a*-1*d*, though there are various conditions depending on the structure and the driving method of recording heads 1*a*-1*d*, fundamental is the driving condition which is able to change the jetting velocity of the ink droplets. As examples of changing the driving conditions in the present invention, FIG. 5(*a*) shows that the voltage of the driving signal to be impressed to recording heads 1*a*-1*d* is changed, FIG. 5(*b*) shows that the pulse width of the driving signal to be impressed to recording heads 1*a*-1*d* is changed, while FIG. 5(*c*) shows that the gradient of the rising edge of the driving signal to be impressed to the recording head is changed.

In regard to the example in which the change of the driving condition is conducted by the change of the driving signal voltage, employed is a recording head which jets the ink droplets by shearing deformation of a wall between the channels, wherein the jetting velocity can become higher when the voltage is raised, while the jetting velocity can become lower when the voltage is lowered. Further, in regard to the example in which the change of the driving condition is carried out by the change of the driving signal pulse width, employed is a recording head which jets the ink droplets by the burst of the air bubble which is generated when the ink is heated by a heater, wherein when the pulse width is changed to be wider, the jetting velocity can become higher, while when the pulse width is changed to be narrower, the jetting velocity can become lower. Yet further, in regard to the example in which the change of driving conditions is carried out by the change of gradient of the rising edge of the driving signal, employed is the recording head which jets ink droplets by the pressure change by a piezo element in the ink chamber, wherein when the gradient is changed to be steeper, the jetting velocity can become higher, while when the gradient is changed to be gentler, the jetting velocity can become lower.

When one main scan is completed by carriage 2, controller 100 drives sub-scanning motor 103 to rotate conveyance roller 4*b*, and intermittently drives conveyance belt 4 to convey recording media P for a predetermined length. The next main scan is repeated, whereby, an image based on the image data is recorded on recording media P.

Next, when the jetting velocity of ink droplets "a" is detected by velocity detecting device 5, controller 100 activates light emitting element 51 to create detecting light L between light emitting element 51 and light receiving element 52, controller 100 drives main scanning motor 102 to move carriage 2 so that recording heads 1*a*-1*d* are driven in main scanning direction "A" to a non-recording area. Next, one of the nozzle arrays of recording heads 1*a*-1*d* is positioned on detecting light L and stopped. Under this condition, controller 100 outputs a jet starting signal (FIRE-M), and controls corresponding drive circuits 101*a*-101*d* at predetermined conditions so that each nozzle can jet ink droplets "a". Jetted ink droplets "a" pass through detecting light L, then light receiving element 52 catches their shadows, which is sensed by detecting section 54.

Detecting section 54 incorporates current amplification section 54*a* which amplifies the light amount signal produced by light receiving element 52, alternating current amplifying section 54*b* which amplifies the variation rate of the light amount signal amplified by current amplification section 54*a*, and comparator 54*c* which compares output signals produced by alternating current amplifying section 54*b* to a standard signal, which is made of the output signal, via low pass filter 54*d*, and outputs a defect-out signal which is greater than the standard signal level, to controller 100.

Figure 4:
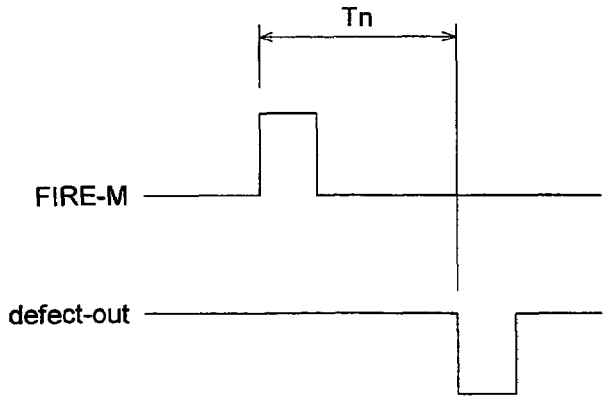
FIG. 4 is a drawing showing a jetting control signal and a detection signal from a detection section.

Accordingly, when a low light amount signal is outputted from light receiving element 52, as ink droplet "A" passes through detecting light L, the defect-out signal shown in FIG. 4 is outputted from detecting section 54. When ink droplets "a" have been properly jetted from the nozzle, and detecting section 54 inputs the defect-out signal into controller 100 within a predetermined time interval, controller 100 measures the time interval (which is time Tn in FIG. 4) from the time when jet starting signal (FIRE-M) of ink droplets "a" is outputted, to the time when the defect-out signal is detected. Then controller 100 calculates the jetting velocity of ink droplets "a", based on the measured time interval and the distance between nozzle surface 11 of recording heads 1*a*-1*d* and detecting light L, which is previously stored in ROM 100*b* of controller 100.

Further, the temperature data of each recording head, detected by temperature detectors 6*a*-6*d* provided in recording heads 1*a*-1*d*, are sent to controller 100. Controller 100 checks the temperatures of the recording heads sent from temperature detector 6*a*-6*d* by a predetermined time.

Additionally, in FIG. 3, numeral 104 represents a power switch which turns the power supply of the printer on or off.

Next, explained is the changing operation of the driving condition of recording heads 1*a*-1*d* in the inkjet printer related to the present invention.

Controller 100 includes a function (a first changing section) which changes the driving conditions for jetting ink droplets "a" from recording heads 1*a*-1*d*, based on the detected results of the jetting velocity for each of recording heads 1*a*-1*d*, detected by velocity detecting device 5, and also a function (a second changing section) which changes the driving conditions for jetting ink droplets "a" from recording heads 1*a*-1*d*, based on the temperatures of each of recording heads 1*a*-1*d*, detected by temperature detecting devices 6*a*-6*d*.

That is, based on the detected results of the jetting velocity for each of recording heads 1*a*-1*d*, detected by velocity detecting device 5, controller 100 changes the driving conditions for outputting into driving circuits 101*a*-101*d*, from the conventional driving conditions so that the jetting velocity of recording heads 1*a*-1*d* agrees with the targeted velocity, when the detected velocity has been changed beyond the targeted velocity to a predetermined velocity.

Velocity detection is not carried out by velocity detecting device 5 while the images are printed, but is carried out when power supply switch 104 is turned on, and/or immediately before the printing operation is conducted.

The change of the driving condition, described above, is generally conducted based on a table including the correlation of the jetting velocity and the driving conditions, which is stored in the memory section.

On the other hand, temperature detection by temperature detecting devices 6*a*-6*d* is used for checking the change of the jetting velocity or the change of the amount of ink droplets, which are generated by the change of the ink viscosity due to a temperature change. After power supply switch 104 is turned on, controller 100 checks the detected results of the temperatures of each of temperature detecting devices 6*a*-6*d*, not only during printing operations but also during non-printing operation.

The change of the driving condition based on the detected result by temperature detecting devices 6*a*-6*d* is conducted at time which differs from the time of the change of the driving conditions based on the detected result by velocity detecting device 5. One method of enabling the change of the driving conditions based on the detected result by temperature detecting devices 6*a*-6*d* is that the driving conditions just before the temperature detection are changed based on the temperature difference from the detected results of temperature detecting devices 6*a*-6*d* at the same time or the adjacent time of the change of the driving condition just before the temperature detection. Another method is that the driving conditions changed by the detected results by velocity detecting device 5 are changed based on the results which are detected by temperature detecting devices 6*a*-6*d* on the same time or just before the change of the driving conditions changed by the detected result of velocity detecting device 5.

In both methods, a table showing the correlation between temperature difference and driving conditions is generally stored in a memory device, and the change of the driving conditions is conducted based on the table.

Accordingly, the driving conditions can be correctly changed without being influenced by any difference of temperature detecting devices 6*a*-6*d*, any difference of the temperature characteristics of ink viscosity and the circuit board, the difference of the machines, and fluctuation by a change of type of ink. Further, since the driving conditions can be changed by the detected results of temperature detecting devices 6*a*-6*d* at a time differing from the time of change of the driving conditions by velocity detecting device 5, the driving condition can be continually changed in accordance with varying temperature of the recording head, even when printing is conducted in which velocity detecting device 5 cannot detect the velocity of ink droplets "a".

Temperature detecting devices 6*a*-6*d* can detect the temperature of the recording heads at a predetermined time after the power switch is turned on. The predetermined time is not limited whether the system is in printing operation or non-printing operation after the power switch is turned on. For example, the predetermined time can be the time after a timer reaches a predetermined time, the time when recording heads 1*a*-1*d* have been moved in main scanning direction "A" for a predetermined number of times, or the time when no data exists in the image data. Among them, preferable is that the detection is conducted at the time after a timer reaches a predetermined time, whereby easy detection can be the temperature of the recording heads which continually changed. The shorter the time stored in the timer, the easier the temperature of the recording heads can be detected.

Still further, it is preferable that temperature detecting devices 6*a*-6*d* detect the temperature of the recording heads while recording heads 1*a*-1*d* practically jet ink droplets, because variation of image density due to temperature change of recording heads 1*a*-1*d* in the printing operation is reduced, which is preferable for printing of high quality images.

Still further, since temperature detecting devices 6*a*-6*d* detect the temperature of the recording heads more frequently than velocity detecting device 5 detects the jetting velocity, the driving conditions can be preferably optimized in accordance with the delicate temperature change of recording heads 1*a*-1*d* during time passage.

Controller 100 changes and controls the driving condition, whenever temperature detecting devices 6*a*-6*d* detect the temperature of the recording heads. Otherwise, for example, previously established threshold values of the temperature difference of the recording heads can be used so that the driving conditions can be changed only when the temperature change of the recording head is greater than the last measured temperature of the recording heads for ±1 degree.

An example of the control of changing the driving condition will be explained via the time chart shown in FIG. 6. The control described below is conducted by the predetermined program stored in ROM 100*b* of controller 100. In this example, the voltage of the driving signal is represented as a driving condition.

Firstly, when the operator turns on power switch 104, controller 100 activates main scanning motor 102 to move carriage 2 on guide rail 3 in main scanning direction "A", and also positions recording heads 1*a*-1*d* above cleaning device 7. After that, controller 100 activates cleaning device 7 to clean recording heads 1*a*-1*d*. In this cleaning operation, aspiration cap 71 strongly aspirates ink from the nozzles so that any clogs of the nozzle are removed, as well as wiping member 72 removes any remaining ink from the nozzle surface, and thereby the jetting conditions of recording heads 1*a*-1*d* are optimized.

Next, controller 100 drives main scanning motor 102 to move carriage 2 on guide rail 3 in main scanning direction "A", and after controller 100 moves recording heads 1*a*-1*d* above velocity detecting device 5, it activates recording heads 1*a*-1*d* at a predetermined voltage, stored in RAM 100*a*, to jet ink droplets, and at this moment, detects the jetting velocity. Since the jetting conditions were optimized by the last cleaning of recording heads 1*a*-1*d*, the jetting velocity can be precisely measured.

Referring to the detected results of velocity detecting device 5, if the jetting velocity of recording heads 1*a*-1*d* is beyond the targeted velocity than a predetermined velocity, controller 100 changes the voltage stored in RAM 100*a* so that the jetting velocity agrees with the targeted velocity.

In addition, after main switch 104 is turned on, controller 100 checks the temperature of recording heads via temperature detecting devices 6*a*-6*d* for a predetermined time. Velocity detecting device 5 detects the jetting velocity of the ink droplets jetted from recording heads 1*a*-1*d*, and after the voltage to be applied to recording heads 1*a*-1*d* based on the above detected velocity is changed, controller 100 stores the temperature of the recording heads, detected by temperature detecting devices 6*a*-6*d* just at the time or close to when the voltage was changed, in RAM 100*a*.

Temperature detection via temperature detecting devices 6*a*-6*d* is repeatedly conducted at predetermined time intervals (3 sec. for example), which is more frequent than the time of the jetting velocity detection by velocity detecting device 5.

Next, via a print start command, controller 100 controls driving circuits 101*a*-101*d* via the voltage change based on the detected results of velocity detecting device 5, and drives recording heads 1*a*-1*d* to start printing based on the image data. Also after the start of printing, controller 100 checks the detected results of temperature detecting devices 6*a*-6*d*, at the predetermined time interval.

After power switch 104 is turned on, and specifically after printing has started, the temperature of the recording heads 1*a*-1*d* increases. When temperature detecting devices 6*a*-6*d* have detected the temperature of the recording heads, controller 100 calculates the temperature difference between the detected temperature and the temperature stored when the voltage was lastly changed, and if the temperature difference is greater than predetermined difference Δt, the voltage difference corresponding to the temperature difference is given to the voltage to be impressed to recording heads 1*a*-1*d*, and thereby the velocity is changed.

Figure 6:
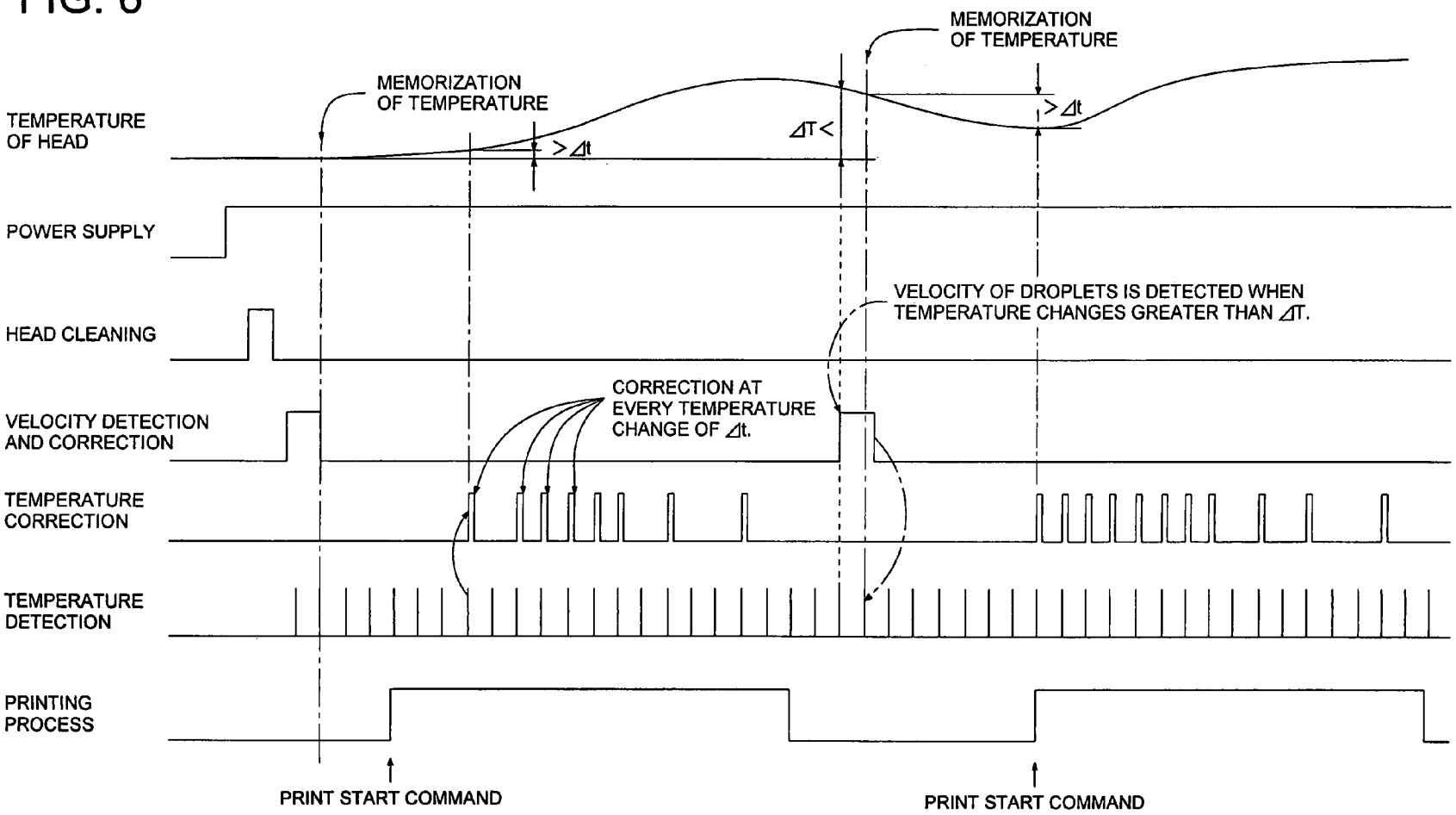
FIG. 6 is a time chart showing an example for the changing control of the driving conditions.

In the time chart shown in FIG. 6, at the fourth temperature detection after the first print start command, the temperature difference from the head temperature stored at the last voltage change (at the change of the voltage performed by the detected results of velocity detecting device 5) finally increases greater than predetermined temperature difference Δt. Since the jetting velocity of the ink droplets is increased by the reduction of viscosity of ink due to the increase of temperature, controller 100 reduces the voltage based on the temperature difference so that the jetting velocity of ink can be decreased.

During the above procedure, the temperature of the recording heads detected by temperature detecting devices 6*a*-6*d* is stored in RAM 100*a* of controller 100, being separated from the temperature of the recording heads which was stored when the voltage was changed based on the detected result of velocity detecting device 5. Further, this changed voltage is overwritten in RAM 100*a* of controller 100. After that, controller 100 controls driving circuits 101*a*-01*d* based on this changed voltage, and drives recording heads 1*a*-1*d* to resume printing operation.

While printing, controller 100 checks the temperature difference between the temperature of the heads detected by temperature detecting devices 6*a*-6*d* and the temperature of the heads stored in the memory, and determines any necessity to change the voltage whether the temperature difference exceeds Δt or not. For example, in the time chart shown in FIG. 6, the temperature difference between the detected temperature at the fifth temperature detection after the first print start command, and the head temperature stored as the last voltage change (which section the voltage change conducted by the detection result of the fourth detection after the first print start) does not exceed Δt, and thereby a voltage change is not carried out. Next, the sixth, seventh, - - - temperature detections are carried out, in which the temperature differences from the last voltage change exceeds Δt so that voltage changes are carried out.

That its, controller 100 checks the head temperature via temperature detecting devices 6*a*-6*d*, and if the temperature difference between said head temperature and the head temperature at the last voltage change exceeds Δt, controller 100 controls to change the voltage corresponding to the temperature difference.

Even when printing is completed, the detection of the head temperature are continued at a predetermined interval by temperature detecting device 6*a*-6*d*. Accordingly, during a time interval after printing is completed till the next print start is commanded, the head temperature is checked by temperature detecting devices 6*a*-6*d*.

During said time interval, controller 100 detects the temperature difference between the detected results of the temperature detecting device 6*a*-6*d* and the head temperature in which the voltage was changed by the last detected results of velocity detecting device 5 stored in RAM 100*a*, and if the temperature difference exceeds ΔT which is a predetermined temperature (but ΔT>Δt), controller 100 controls velocity detecting device 5 to measure the jetting velocity of each of recording heads 1*a*-1*d*, and changes the voltage using the detected results. Via this method, if the head temperature changes are extraordinary, errors which might be generated during the change of the voltage based on the temperature difference can be prevented.

After that, when the print start command is given, controller 100 detects the head temperature via temperature detecting devices 6*a*-6*d* in the same manner, and whenever the detected results exceed the temperature at the last voltage change, being greater than Δt, controller 100 changes the voltage.

Accordingly, controller 100 changes the voltage of recording heads 1*a*-1*d*, during printing condition as well as during non-printing condition. Therefore, printing is continuously and stably conducted, independent of structural and ambient differences, and excellent image quality is continuously achieved.

Figure 7:
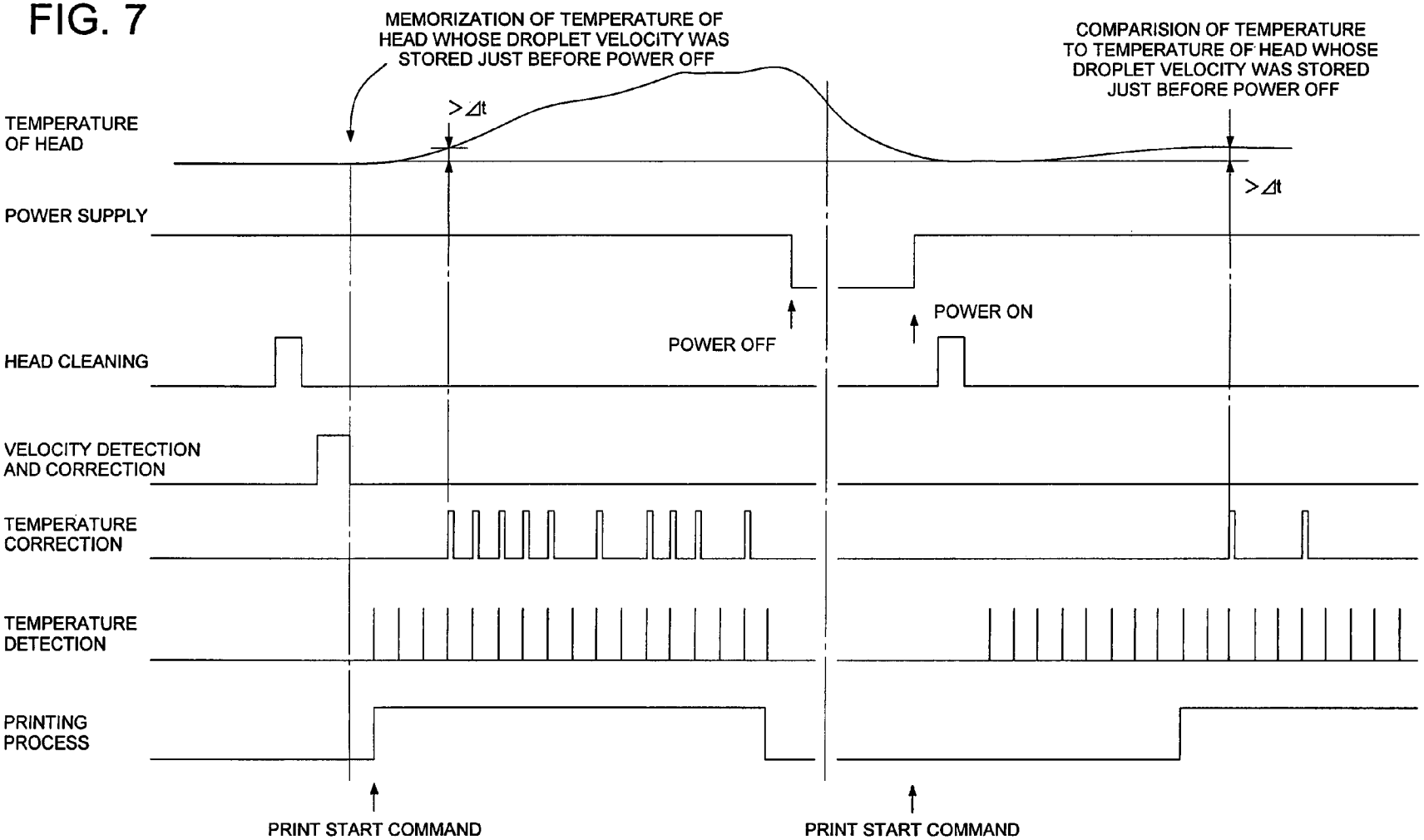
FIG. 7 is a time chart showing another example for the changing control of the driving conditions.

In addition, in the above explained time chart, after power supply switch 104 is turned on, controller 100 regulates cleaning device 7 to clean recording heads 1*a*-1*d*, as well as regulating velocity detecting device 5 which detects the jetting velocity. However, as shown in the time chart of FIG. 7, just before power supply switch 104 is turned off, controller 100 changes the voltage based on the detected result of velocity detecting device 5. At, or almost at the same moment of said change of voltage, the head temperature detected by temperature detecting devices 6*a*-6*d* is stored. When power switch 104 is turned on again, the temperature difference between the stored head temperature and the head temperature after power switch 104 is turned on does not exceed predetermined temperature Δt, a new jetting velocity is not detected, which is preferable. By omitting the detection of the jetting velocity, the inkjet printer can more quickly initiate the print start condition.

Figure 8:
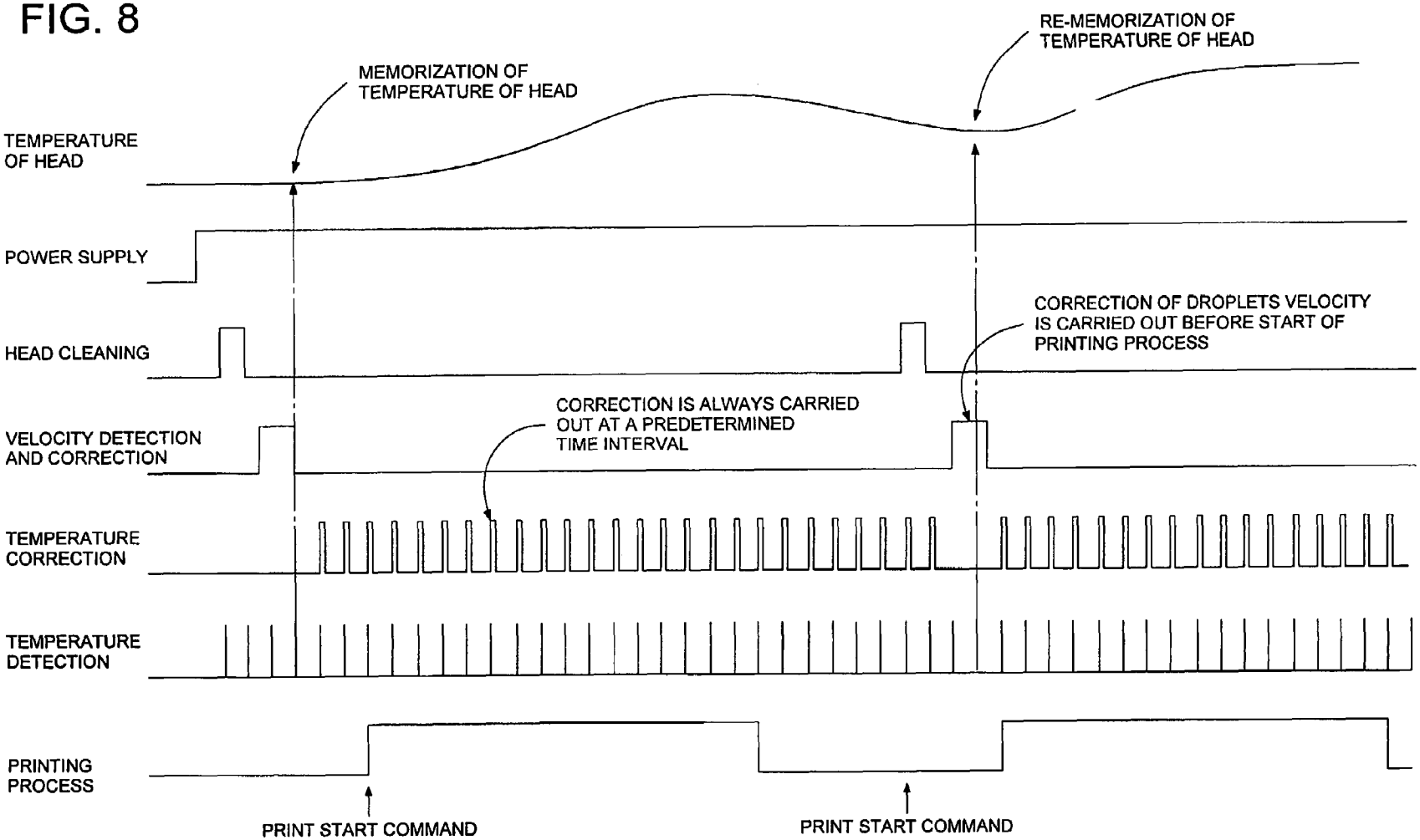
FIG. 8 is a time chart showing a third example for the changing control of the driving conditions.

FIG. 8 is a time chart showing the third example of the changing operation of the driving conditions. The voltage is also used in this example as the driving condition.

In this example, the following actions are the same as those described in FIG. 6. That is, after main switch 104 is turned on, cleaning device 7 cleans the heads, velocity detecting device 5 detects the jetting velocity of recording heads 1*a*-1*d*, the voltage is changed based on the above detected results, and temperature detecting devices 6*a*-6*d* check the temperature of recording heads at a predetermined time. However, the difference is that velocity detecting device 5 detects the jetting velocity, and the voltage is changed based on the detected results, after which whenever temperature detecting devices 6*a*-6*d* detect the head temperature, the controller 100 changes the voltage.

That is, velocity detecting device 5 detects the jetting velocity of the ink droplets, whereby the voltage is changed based on the detected result, then RAM 100*a* of controller 100 stores the head temperature detected by temperature detecting devices 6*a*-6*d* at or almost at the same time as the change of voltage. After that, during the printing condition, as well as during the non-printing condition, whenever temperature detecting devices 6*a*-6*d* detect the head temperature, controller 100 calculates the temperature difference between said head temperature and the head temperature which was stored when the voltage was changed based on the last detected results of velocity detecting device 5. Then controller 100 changes the voltage using the voltage change corresponding to the temperature difference.

In this example, after power switch is turned on, whenever the print start command is entered, cleaning device 7 definitely cleans recording heads 1*a*-1*d*, and velocity detecting device 5 definitely detects the jetting velocity of the ink droplets just before printing. Further, the voltage, which is to be changed based on the head temperature continuously detected at predetermined intervals via temperature detecting devices 6*a*-6*d*, is always based on the head temperature which was detected when the voltage was changed based on the detected result of velocity detecting device 5. Accordingly, driving conditions can be established, having fewer errors from the targeted velocity.

In the present invention, the number of recording heads of the inkjet printer is not limited to the four shown in FIG. 1, but also possible is one or a plural number except for four. Further, if plural recording heads are provided, a temperature detecting device needs not be provided for each recording head, but one temperature detecting device can be provided to detect the plural recording heads.

Yet further, the temperature detecting device in the present invention needs not detect the temperature of the actual recording head, but it is possible to assemble the temperature detecting device to detect the ambient environmental temperature of the temperature detecting device. In such case, it is not necessary that the temperature detecting device comes into contact with the recording heads, but the temperature detecting device may be provided adjacent to the recording heads. To detect the ambient environmental temperature, it is not necessary to provide plural temperature detecting devices, but it is possible to use a single temperature detecting device in such way that a temperature detecting device detects the temperature of the ambient environmental temperature of the plural temperature detecting devices.

The inkjet printer relating to the present invention can be used for printing the images, being text or photograph, on the recording media, being either paper, plastic film or fabric, as well as various materials, such as color filter for an EL panel or liquid crystal display, and circuit boards, by jetting microscopic ink droplets from the nozzles of the recording heads, and precisely depositing the ink droplets onto the above recording media, whereby the inkjet printer relating to the present invention can be used on an apparatus which produces the desired recorded images by using said ink.

The effects of the invention will be described below. Based on the invention described in Structure 1, the driving conditions of the recording head are changed based on the detected results of the velocity detecting section as well as on the detected result of the temperature detecting section on the different times, and thereby, the jetting velocity of the ink droplets becomes the targeted velocity. Accordingly, the driving conditions are optimized even when the velocity detecting section cannot detect the velocity, that is, printing is continuously and stably conducted, independent from structural difference and ambient difference, and excellent image quality is continuously attained.

Based on the invention described in Structure 2, since the driving condition can be changed based on the temperature difference on just or near the time when the driving condition was last changed, printing is continuously and stably conducted, independent from structural and ambient differences, and excellent image quality is continuously achieved.

Based on the invention described in Structure 3, since the driving condition is always changed based on temperature differences at the time when the jetting velocity of the ink droplets was detected, the driving condition having a very small error from the targeted velocity can be established.

Based on the invention described in Structure 4, the driving conditions can be optimized, based on differences between the temperature of the recording head or the ambient temperature near the recording head over an elapse of time.

Based on the invention described in Structure 5, since the jetting velocity is not detected while printing, printing operation is not discontinued, and any change of driving conditions is often conducted based on changes of temperature, which prevents a change of density of the image, even when the temperature of the recording head or its ambient temperature changes.

Based on the invention described in Structure 6, though the detection of the ink droplets is not carried out, the driving conditions of the recording head after the activation of electrical power can be established so that the ink droplets can be jetted at the targeted velocity.

Based on the invention described in Structure 7, since the detection of the velocity of the ink droplets is not carried out during the printing process, the printing operation is not discontinued, which prevents a change of density of the image, even when the temperature of the recording head or its ambient temperature changes.

Based on the invention described in Structure 8, since the detection of the velocity of the ink droplets is not conducted during printing, the printing condition is not discontinued, and while printing the driving conditions are changed based on the difference of the temperature from the temperature at the time when the jetting velocity of the ink droplets is detected, which prevents a change of density of the image, even when the temperature of the recording head or its ambient area changes, and thereby the driving condition close to the targeted velocity can be established.

Based on the invention described in Structure 9, at least one of the driving signal voltage, pulse width of the driving signal, and gradient of the rising edge of the driving signal is changed so that the driving conditions can be changed.

Based on the invention described in Structure 10, before the velocity detecting section detects the jetting velocity, the jetting condition of the recording head can be normalized, to enable correct detection of the jetting velocity.

Based on the invention described in Structure 11, clogged nozzles of the recording head and ink adhered on the face of the nozzle are cleaned, whereby the jetting conditions of the recording head are effectively normalized.

What is claimed is:

1. An inkjet printer, comprising:

a recording head having a nozzle to jet ink droplets;

a control section to control jetting of the ink droplets from the nozzle of the recording head at predetermined driving conditions;

a velocity detecting section to detect an ink droplet jetting velocity from the nozzle of the recording head;

a temperature detecting section to detect a temperature of the recording head or at the recording head;

a first changing section to change a driving condition to alter the ink droplet jetting velocity to a targeted velocity, based on a detected ink droplet jetting velocity; and a second changing section to change the driving condition at a time differing from a time when the first changing section changes the driving condition, to alter the ink droplet jetting velocity to the targeted velocity, based on a detected temperature.

2. The inkjet printer of claim 1, wherein the second changing section changes the driving condition which was last changed by either the first changing section or the second changing section, based on a difference between a detected temperature which was detected just at or near the time when the last driving condition was changed and a detected temperature which is currently detected.

3. The inkjet printer of claim 1, wherein the second changing section changes the driving condition changed by the first changing section, based on a difference between a detected temperature which was detected just at or near the time when the driving condition was changed and a detected temperature which is currently detected.

4. The inkjet printer of claim 1, wherein the second changing section changes the driving condition more frequently than the first changing section changes the driving condition.

5. The inkjet printer of claim 1, wherein the velocity detection and the change of the driving condition by the first changing section are conducted when electrical power is supplied to the inkjet printer and/or just before printing is carried out, and wherein the temperature detection and the change of the driving condition conducted by the second changing section are conducted at times and more frequently than the velocity detection and the change of the driving condition conducted by the first changing section.

6. The inkjet printer of claim 1, further comprising a memory section which stores an least:

a driving condition changed by the first changing section before the inkjet printer is deactivated; and a detected temperature which was detected just at or near the time when the driving condition was changed;

wherein when electrical power is supplied to the inkjet printer, the second changing section changes the driving condition stored in the memory section, based on a difference between a detected temperature which was detected when the electrical power is supplied and the detected temperature stored in the memory section.

7. The inkjet printer of claim 1, wherein the driving condition corresponds to any one of a change of driving signal voltage, a change of pulse width of the driving signal, or a change of gradient of rising edge of the driving signal.

8. The inkjet printer of claim 1, wherein the second changing section changes the last driving condition changed by either the first changing section or the second changing section, based on a difference between a detected temperature which was detected at or near the time when the last driving condition was changed and a detected temperature which is currently detected, wherein the velocity detection and the change of the driving condition by the first changing section are conducted when the electrical power is supplied and/or just before printing is conducted, and wherein the temperature detection and the change of the driving condition by the second changing section are conducted while printing.

9. The inkjet printer of claim 8, wherein the driving condition corresponds to any one of a change of driving signal voltage, a change of pulse width of the driving signal, or a change of gradient of rising edge of The driving signal.

10. The inkjet printer of claim 1, wherein the second changing section changes the driving condition which was last changed by the first changing section, based on a difference between a detected temperature detected just at or near the time when the driving condition was changed and a detected temperature which is currently detected, wherein both the velocity detection and the change of the driving condition by the first changing section are conducted when the electrical power is supplied to the inkjet printer and/or just before printing is started, and wherein the temperature detection and the change of the driving condition by the second changing section are conducted while printing.

11. The inkjet printer of claim 10, wherein the driving condition corresponds to any one of a change of driving signal voltage, a change of pulse width of the driving signal, or a change of gradient of rising edge of the driving signal.

12. The inkjet printer of claim 1, further comprising;

a cleaning section to normalize condition of the recording head by cleaning the recording head; and a controlling section to operate the cleaning section just before the velocity detection.

13. The inkjet printer of claim 12, wherein the cleaning section includes a wiping section to wipe the nozzle surfaces, and/or an ink aspiration section to aspirate ink from the nozzle.

* * * * *